US009809756B2

(12) United States Patent
Soultanidis et al.

(10) Patent No.: US 9,809,756 B2
(45) Date of Patent: Nov. 7, 2017

(54) UPGRADING PYROLYSIS TAR

(71) Applicant: ExxonMobil Chemical Patents Inc., Baytown, TX (US)

(72) Inventors: Nikolaos Soultanidis, Houston, TX (US); Keith G. Reed, Houston, TX (US); Teng Xu, Houston, TX (US); David T. Ferrughelli, Flemington, NJ (US); Luc R. M. Martens, Meise (BE)

(73) Assignee: ExxonMobil Chemical Patents Inc., Baytown, TX (US)

( * ) Notice: Subject to any disclaimer, the term of this patent is extended or adjusted under 35 U.S.C. 154(b) by 313 days.

(21) Appl. No.: 14/678,427

(22) Filed: Apr. 3, 2015

(65) Prior Publication Data

US 2015/0344785 A1 Dec. 3, 2015

Related U.S. Application Data

(60) Provisional application No. 62/005,679, filed on May 30, 2014.

(30) Foreign Application Priority Data

Aug. 18, 2014 (EP) ..... 14181260

(51) Int. Cl.

| | |
|---|---|
| ***C10C 1/20*** | (2006.01) |
| ***C10G 45/72*** | (2006.01) |
| ***C10G 47/36*** | (2006.01) |
| ***C10G 49/00*** | (2006.01) |
| ***C10G 49/26*** | (2006.01) |
| ***C10G 75/04*** | (2006.01) |

(52) U.S. Cl.

CPC ..... *C10C 1/205* (2013.01); *C10G 45/72* (2013.01); *C10G 47/36* (2013.01); *C10G 49/002* (2013.01); *C10G 49/26* (2013.01); *C10G 75/04* (2013.01)

(58) Field of Classification Search

CPC ..... C10C 1/205; C10G 45/72; C10G 75/04; C10G 49/002; C10G 49/26; C10G 47/36

See application file for complete search history.

(56) References Cited

U.S. PATENT DOCUMENTS

| | | | |
|---|---|---|---|
| 6,632,351 | B1 | 10/2003 | Ngan et al. |
| 7,090,765 | B2 | 8/2006 | Spicer et al. |
| 7,097,758 | B2 | 8/2006 | Stell et al. |
| 7,138,047 | B2 | 11/2006 | Stell et al. |
| 7,220,887 | B2 | 5/2007 | Stell et al. |
| 7,235,705 | B2 | 6/2007 | Stell |
| 7,244,871 | B2 | 7/2007 | Stell et al. |
| 7,247,765 | B2 | 7/2007 | Stell et al. |
| 7,297,833 | B2 | 11/2007 | Beattie et al. |
| 7,311,746 | B2 | 12/2007 | Stell et al. |
| 7,312,371 | B2 | 12/2007 | Stell et al. |

(Continued)

FOREIGN PATENT DOCUMENTS

| | | | |
|---|---|---|---|
| DE | 4308507 | | 9/1993 |
| IT | DE4308507 | * | 9/1993 |

*Primary Examiner* — Randy Boyer
*Assistant Examiner* — Juan Valencia

(57) ABSTRACT

The invention relates to pyrolysis tar upgrading processes, and in particular for decreasing reactor pressure drop when the upgrading includes converting pyrolysis tar in a reactor. The invention also relates to upgraded pyrolysis tar, and the use of upgraded pyrolysis tar, e.g., as a fuel oil blending component.

25 Claims, 2 Drawing Sheets

(56) References Cited

U.S. PATENT DOCUMENTS

| | | | | |
|---|---|---|---|---|
| 7,351,872 | B2 | 4/2008 | Stell et al. | |
| 7,488,459 | B2 | 2/2009 | Stell et al. | |
| 7,578,929 | B2 | 8/2009 | Stell et al. | |
| 7,820,035 | B2 | 10/2010 | McCoy et al. | |
| 2013/0233764 | A1 | 9/2013 | Brown et al. | |
| 2014/0061094 | A1 | 3/2014 | Xu et al. | |
| 2014/0061095 | A1* | 3/2014 | Beech, Jr. ..... | C10G 69/06<br>208/73 |
| 2014/0061096 | A1 | 3/2014 | Brown et al. | |
| 2014/0061100 | A1 | 3/2014 | Lattner et al. | |
| 2014/0061904 | A1 | 3/2014 | Liao | |

* cited by examiner

UPGRADING PYROLYSIS TAR

PRIORITY CLAIM

This application claims priority to and the benefit of U.S. Provisional Application No. 62/005,679, filed May 30, 2014, and European Application No. 14181260.2, filed Aug. 18, 2014, all of which are incorporated by reference in their entireties.

FIELD

The invention relates to pyrolysis tar upgrading processes, and in particular for decreasing reactor pressure drop when the upgrading includes converting pyrolysis tar in a hydroprocessing reactor. The invention also relates to upgraded pyrolysis tar, and the use of upgraded pyrolysis tar, e.g., as a fuel oil blending component.

BACKGROUND

Pyrolysis processes, such as steam cracking, can be utilized for converting saturated hydrocarbons to higher-value products such as $C_{2+}$ olefin, e.g., ethylene and propylene. Besides these useful products, hydrocarbon pyrolysis can also produce a significant amount of relatively low-value products, such as pyrolysis tar. When the hydrocarbon pyrolysis includes steam cracking, the pyrolysis tar is generally referred to as steam cracker tar ("SCT").

Pyrolysis tar, including SCT, can be upgraded by conventional hydroprocessing, but doing so leads to reactor fouling and/or catalyst coking leading to a rapid decrease in the amount of upgraded pyrolysis tar that can be recovered. Although catalyst coking can be lessened by operating the process at an elevated hydrogen partial pressure, doing so leads to increased hydrogen demand and equipment costs, which worsen process economics. Catalyst coking can also be lessened by hydroprocessing at relatively low temperatures and diminished space velocity, but these conditions favor undesired hydrogenation reactions.

Although undiluted pyrolysis tar can be hydroprocessed, it is conventional to combine pyrolysis tar with a utility fluid upstream of the hydroprocessing in order to lessen the rate of increase in reactor pressure-drop. Unconverted utility fluid can be separated from the hydroprocessor's effluent, e.g., for recycle and re-use. When no utility fluid is used, a rapid pressure-drop increase is observed across the hydroprocessing reactor, e.g., between the reactor's inlet and outlet. The increased pressure-drop has been attributed to the presence in the SCT of molecules having an atmospheric boiling point ≥565° C., known as "tar heavies", which include asphaltenes and other high molecular weight molecules.

When the utility fluid has significant aromatics content, the rate of reactor pressure drop is lessened. The hydroprocessed tar product generally has a decreased viscosity, decreased atmospheric boiling point range, and increased hydrogen content over that of the pyrolysis tar feed, resulting in improved compatibility with fuel oil blend-stocks.

U.S. Patent Application Publication No. 2014-0061094 A1 discloses upgrading steam cracked tar in at least one hydroprocessing stage in the presence of a utility fluid. The utility fluid comprises aromatics (i.e., comprises molecules having at least one aromatic core) and has an ASTM D86 10% distillation point ≥60° C. and a 90% distillation point ≤360° C. Even though the rate of pressure drop is lessened, reactor pressure drop eventually reaches a point at which the reactor must be shut down for rejuvenating or replacing the hydroprocessing catalyst and for removing deposits such as coke from the reactor internals.

It is desired to produce such hydroprocessed products in continuous or semi-continuous processes over relatively long time intervals without an undesirable increase in reactor pressure-drop. It particularly desirable to be able to do so for a wide range of utility fluid compositions. Should operation of the pyrolysis tar hydroprocessor and/or associated equipment result in a significant increase in reactor pressure-drop, it is desired to lessen the pressure-drop without a significant interruption of the tar hydroprocessing.

SUMMARY

An increase in reactor pressure drop is observed over time when hydroprocessing a mixture of pyrolysis tar and an aromatic utility fluid, leading to a diminished recovery rate of hydroprocessed tar. A reactor pressure drop increase is also observed when there is a significant change in pyrolysis tar composition and/or hydroprocessing process conditions. In each of these cases, the increase in reactor pressure drop is believed to result from the accumulation of foulant in the hydroprocessing reactor and associated equipment. It has been found that the increased pressure drop can be mitigated by periodically decreasing the weight ratio of the pyrolysis tar to the utility fluid in the feed.

Accordingly, in one aspect, the invention relates to a process for hydroprocessing pyrolysis tar that mitigates fouling induced reactor pressure drop. The process comprises two steps. The first step is hydroprocessing a feed comprising pyrolysis tar and a utility fluid in a hydroprocessing reactor, wherein the utility fluid typically comprises ≥90.0 wt. % of aromatics and ≤10.0 wt. % of paraffin. The second step is periodically decreasing the weight ratio of the pyrolysis tar to the utility fluid in the feed.

More particularly, the invention relates to a pyrolysis tar upgrading process which includes providing a reactor zone containing catalyst, a treat gas, and a feed mixture. The feed mixture includes (i) a first utility fluid, which comprises aromatics, and (ii) pyrolysis tar. At least a portion of the feed mixture is converted in the reactor zone to a conversion product, which is conducted away from the reactor. The hydroprocessing reactor generally has an initial pressure-drop $\Delta P_1$ at the start of the converting. After the reactor pressure drop increases to a second pressure-drop $\Delta P_2$, additional utility fluid (e.g., additional first utility fluid and/or a second utility fluid) is introduced into the reactor to decrease the pyrolysis tar:utility fluid weight ratio. Doing so decreases the reactor pressure drop to a value $\Delta P_3$, where $\Delta P_3$ is $<\Delta P_2$ and optionally $\Delta P_3$ is $\leq\Delta P_1$. After the desired pressure drop is achieved, the amount of additional first utility fluid (or the amount of second utility fluid) can then be lessened or halted.

A reactor pressure drop increase has also been observed when the process is first started, e.g., when transitioning the hydroprocessing reactor from catalyst activation mode to hydroprocessing mode. It has been found that this difficulty can be overcome by substituting utility fluid for at least a portion of the activating fluid used for catalyst activation, preferably before any pyrolysis tar is introduced into the reactor.

Accordingly, certain aspects of the invention relate to a pyrolysis tar upgrading process, the process comprises providing a reactor zone containing catalyst, a utility fluid comprising ≥90.0 wt. % of aromatics and ≤10.0 wt. % of paraffin; a pyrolysis tar; an activating fluid, and a treat gas.

The catalyst in the reactor zone is exposed to the treat gas and activating fluid under catalyst activation conditions to at least partially activate the catalyst. After the catalyst is sufficiently activated, the flow of activating fluid is decreased and the flow of utility fluid is increased. Utility fluid is provided to the reactor at an LHSV ≥0.1 $m^3$ of utility fluid per $m^3$ of the catalyst. Pyrolysis tar is transferred to the reactor for pyrolysis tar hydroprocessing after the utility fluid has swept at least a portion of the activating fluid from the reactor.

DETAILED DESCRIPTION

Figure 1:
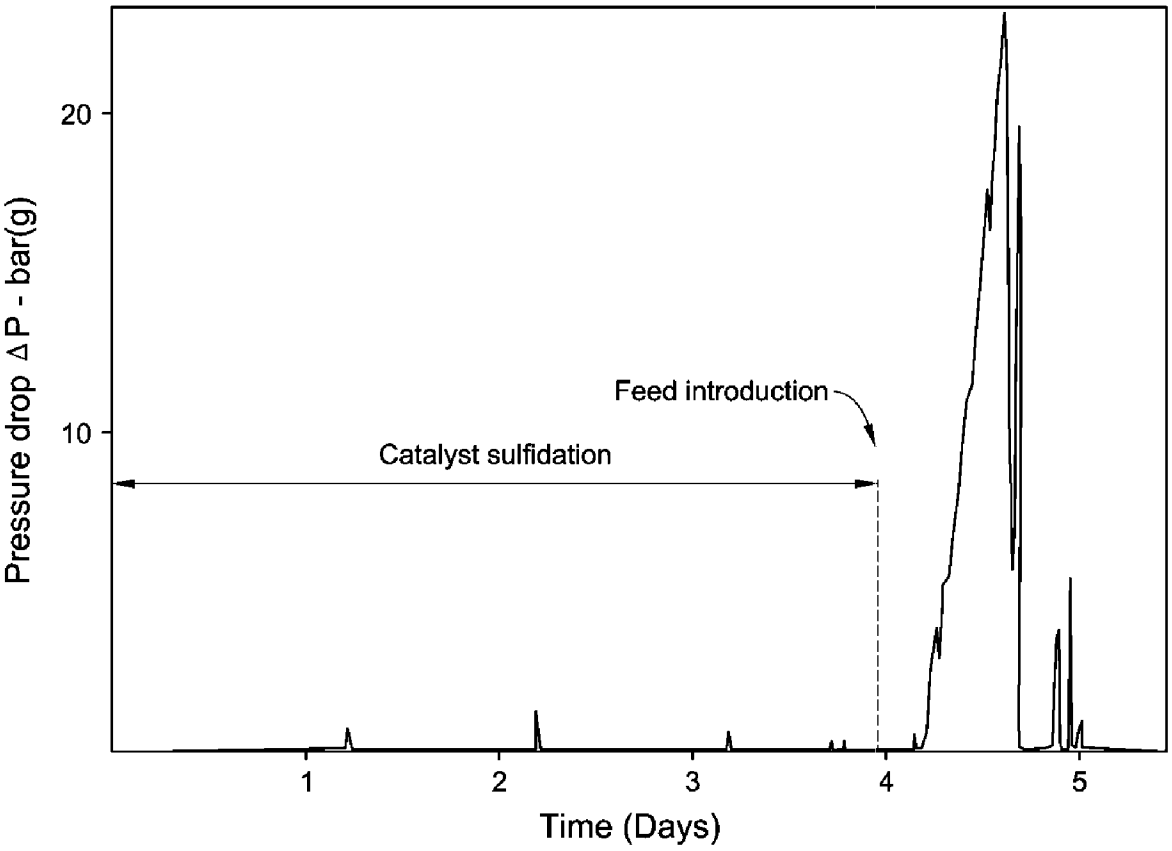
FIG. 1 is a graph showing the variation of hydroprocessing reactor pressure over time during catalyst activation and after the start of pyrolysis tar hydroprocessing.

The invention is based in part on the development of a pyrolysis tar upgrading process which can operate for relatively long time intervals without the need to take the hydroprocessing reactor off-line for removing deposits, or for regenerating, rejuvenating or replacing hydroprocessing catalyst, etc. This benefit is achieved when upgrading any of the specified pyrolysis tars, and when switching the reactor feed from one pyrolysis tar to another.

It has been found that an undesirably large reactor pressure drop during pyrolysis tar hydroprocessing can be lessened by decreasing pyrolysis tar:utility fluid weight ratio in the hydroprocessing reactor under specified reactor operating conditions. It was expected that that increased pressure drop resulted from the presence of solid or semi-solid foulants which are derived from pyrolysis tar during processing, and which were believed to be resistant to dispersal in hydrocarbon fluid. It is therefore surprising that exposing accumulated foulant to the specified utility fluid, which can be the same utility fluid utilized during pyrolysis tar hydroprocessing, results in removing foulant from reactor components and ancillary equipment. The specified utility fluid can be conducted through the reactor while maintaining the reactor at substantially the same temperature and pressure utilized for pyrolysis tar hydroprocessing, e.g., a temperature ≥50° C., such as in the range of 100° C. to 430° C., or 100° C. to 300° C., and a pressure in the range of from 34 bar gauge ("bar(g)") to 68 bar(g). Using the specified utility fluid under these conditions for foulant removal has been observed to decrease reactor pressure drop, e.g., by a factor of ≥1.5, e.g., a factor of ≥2.0, such as ≥3.0. Reactor pressure drop is substantially equal to the average pressure at the reactor inlet minus the average pressure at the reactor outlet. Conventional equipment can be used for measuring average reactor pressure, e.g., conventional mechanical, electrical, and electro-mechanical pressure sensors, but the invention is not limited thereto.

Foulant can be removed during pyrolysis tar hydroprocessing by decreasing the pyrolysis tar:utility fluid weight ratio, e.g., by decreasing the amount of pyrolysis tar conducted to the hydroprocessing reactor and/or increasing the amount of utility fluid conducted to the pyrolysis reactor. When the utility fluid comprises a mixture, e.g., a mixture of first and second utility fluids, the pyrolysis tar:utility fluid weight ratio can be decreased by (i) increasing the relative amount of the first and/or second utility fluid and/or (ii) decreasing the amount of pyrolysis tar.

Although it is not required, it is beneficial to lessen or halt the flow of treat gas to the hydroprocessing reactor during foulant removal. Optionally, a flow of substantially inert gas (e.g., one or more of nitrogen, helium, argon, neon, etc.) can be conducted through the pyrolysis reactor with the utility fluid during foulant removal.

Start-up of a pyrolysis tar hydroprocessing reactor generally includes activation of the hydroprocessing catalyst. The activation can include contacting the catalyst under catalyst activation conditions with an effective amount of at least one activator, e.g., ethyldisulfide. The activator is generally one component of an activating fluid, the activating fluid further comprising carrier fluid, e.g., a paraffinic solvent, for conveying the activator to the catalyst. The activating fluid can comprise, consist essentially of, or even consist of activator and carrier fluid. It has been observed that transitioning the reaction from activation mode to hydroprocessing mode (for pyrolysis tar upgrading) leads to a rapid increase in reactor pressure drop. While not wishing to be bound by any theory or model, it is believed that this pressure drop increase results at least in part from incompatibilities between the carrier fluid, the pyrolysis tar, and the utility fluid. It has been found that this difficulty can be overcome by operating the hydroprocessing reactor at an initial pyrolysis tar:utility fluid weight ratio under specified conditions for a specified time following catalyst activation, optionally in the presence of inert gas. The pyrolysis tar: utility fluid weight ratio is then increased to a desired value for pyrolysis tar upgrading, with the reactor operating under the specified pyrolysis tar upgrading process conditions.

Definitions

The following terms are defined for all purposes of this description and appended claims.

The term "pyrolysis tar" means (a) a mixture of hydrocarbons having one or more aromatic components and optionally (b) non-aromatic and/or non-hydrocarbon molecules, the mixture being derived from hydrocarbon pyrolysis, with at least 20% of the mixture having a boiling point at atmospheric pressure that is ≥ about 550° F. (290° C.). Certain pyrolysis tars have an initial boiling point ≥200° C. Optionally, ≥90.0 wt. % of the pyrolysis tar has a boiling point at atmospheric pressure ≥550° F. (290° C.). Pyrolysis tar can comprise, e.g., ≥50.0 wt. %, e.g., ≥75.0 wt. %, such as ≥90.0 wt. %, based on the weight of the pyrolysis tar, of hydrocarbon molecules (including mixtures and aggregates thereof) having (i) one or more aromatic components and (ii) a molecular weight ≥ about $C_{15}$. Pyrolysis tar generally has a metals content, $\leq 1.0\times10^3$ ppmw, based on the weight of the pyrolysis tar, e.g., an amount of metals that is far less than that found in crude oil (or crude oil components) of the same average viscosity. "SCT" means pyrolysis tar obtained from steam cracking.

"Tar Heavies", or "TH", means a product of hydrocarbon pyrolysis, the TH having an atmospheric boiling point ≥565° C. and comprising ≥5.0 wt. % of molecules having a plurality of aromatic cores based on the weight of the product. The TH are typically solid at 25.0° C. and generally include the fraction of pyrolysis tar that is not soluble in a 5:1 (vol.:vol.) ratio of n-pentane:pyrolysis tar at 25.0° C. TH generally includes asphaltenes and other high molecular weight molecules. The term "asphaltene(s)" means heptane-insolubles, which can be measured following ASTM D3279.

The term "Cn" hydrocarbon wherein n is a positive integer, e.g., 1, 2, 3, 4, or 5, means a hydrocarbon having n number of carbon atom(s) per molecule. The term "Cn+" hydrocarbon wherein n is a positive integer, e.g., 1, 2, 3, 4, or 5, means hydrocarbon having at least n number of carbon atom(s) per molecule. The term "Cn-" hydrocarbon wherein n is a positive integer, e.g., 1, 2, 3, 4, or 5, means hydrocarbon having no more than n number of carbon atom(s) per molecule.

The term "aromatics" means hydrocarbon molecules containing at least one aromatic core.

The term "substantially-saturated hydrocarbon" means hydrocarbon comprising ≤1.0 mole % of molecules which contain at least one double and/or at least one triple bond.

The term "hydrocarbon" encompasses mixtures of hydrocarbon, including those having different values of n.

The term "Periodic Table" means the Periodic Chart of the Elements, as appearing on the inside cover of The Merck Index, Twelfth Edition, Merck & Co. Inc., 1996.

Aspects of the invention relating to SCT upgrading will now be described in more detail. The invention is not limited to these aspects, and this description is not meant to foreclose other aspects within the broader scope of the invention, such as those which include the upgrading of other kinds of pyrolysis tar.

Producing SCT by Steam Cracking

Conventional steam cracking utilizes a pyrolysis furnace which has two main sections: a convection section and a radiant section. The feed typically enters the convection section of the furnace where the feed's hydrocarbon is heated and vaporized by indirect contact with hot flue gas from the radiant section and by direct contact with the feed. The vaporized feed is then introduced into the radiant section where ≥50% (weight basis) of the cracking takes place. Effluent is conducted away from the pyrolysis furnace, the effluent comprising (i) products resulting from the pyrolysis of the feed and (ii) any unreacted feed components. At least one separation stage is generally located downstream of the pyrolysis furnace, the separation stage being utilized for separating from the effluent one or more of light olefin, steam-cracker naphtha, steam cracker gas oil, SCT, water, and/or unreacted hydrocarbon components of the feed, etc. The separation stage can comprise, e.g., a primary fractionator. Generally, a cooling stage is located between the pyrolysis furnace and the separation stage. Conventional cooling means can be utilized by the cooling stage, e.g., one or more direct quench and/or or indirect heat exchange, but the invention is not limited thereto.

In certain aspects, SCT is obtained as a product of pyrolysis conducted in one or more pyrolysis furnaces, e.g., one or more steam cracking furnaces. Besides SCT, such furnaces generally produce (i) vapor-phase products such as one or more of acetylene, ethylene, propylene, butenes, and (ii) liquid-phase products comprising, e.g., one or more of $C_{5+}$ molecules, and mixtures thereof. The liquid-phase products are generally conducted together to a separation stage, e.g., a primary fractionator, for separation of one or more of (a) overheads comprising steam-cracked naphtha ("SCN", e.g., $C_5$-$C_{10}$ species) and steam cracked gas oil ("SCGO"), the SCGO comprising (a) ≥90.0 wt. % based on the weight of the SCGO of molecules (e.g., $C_{10}$-$C_{17}$ species) having an atmospheric boiling point in the range of about 400° F. to 550° F. (200° C. to 290° C.), and (b) a bottoms stream comprising ≥90.0 wt. % SCT, based on the weight of the bottoms stream. The SCT can have, e.g., a boiling range ≥200° C., e.g., ≥290° C., and can comprise molecules and mixtures thereof having a molecular weight ≥ about $C_{15}$.

The feed typically comprises hydrocarbon and a diluent such as steam. In certain aspects, the feed comprises ≥10.0 wt. % hydrocarbon, based on the weight of the feed, e.g., ≥25.0 wt. %, ≥50.0 wt. %, such as ≥65.0 wt. %. Generally, the feed comprises steam in an amount in the range of from 10.0 wt. % to 90.0 wt. %, based on the weight of the feed, with the remainder of the feed comprising (or consisting essentially of, or consisting of) the hydrocarbon. Such a feed can be produced by combining hydrocarbon with steam, e.g., at a ratio of 0.1 kg to 1.0 kg steam per kg hydrocarbon, or a ratio of 0.2 kg to 0.6 kg of steam per kg of hydrocarbon.

Although the feed's hydrocarbon can comprise one or more of light hydrocarbons such as methane, ethane, propane, butane etc., it can be particularly advantageous to utilize the invention in connection with a feed comprising a significant amount of higher molecular weight hydrocarbons because the pyrolysis of these molecules generally results in more SCT than does the pyrolysis of lower molecular weight hydrocarbons. As an example, the feed can comprise ≥1.0 wt. % or ≥25.0 wt. % based on the weight of hydrocarbons in the feed that are in the liquid phase at ambient temperature and atmospheric pressure.

In certain aspects, the feed's hydrocarbon comprises 5 wt. % of non-volatile components, based on the weight of the hydrocarbon portion, e.g., 30 wt. %, such as ≥40 wt. %, or in the range of 5 wt. % to 50 wt. %. Non-volatile components are the fraction of the hydrocarbon feed with a nominal boiling point above 1100° F. (590° C.) as measured by ASTM D-6352-98 or D-2887. Non-volatile components can include coke precursors, which are moderately heavy and/or reactive molecules, such as multi-ring aromatic compounds, which can condense from the vapor phase and then form coke under the operating conditions encountered in the present process of the invention. Examples of suitable hydrocarbons include, one or more of steam cracked gas oil and residues, gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids, Fischer-Tropsch gases, natural gasoline, distillate, virgin naphtha, crude oil, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, atmospheric residue, heavy residue, $C_4$/residue admixture, naphtha/residue admixture, gas oil/residue admixture, and crude oil. The feed's hydrocarbon can have a nominal final boiling point of at least about 600° F. (315° C.), generally greater than about 950° F. (510° C.), typically greater than about 1100° F. (590° C.), for example greater than about 1400° F. (760° C.). Nominal final boiling point means the temperature at which 99.5 weight percent of a particular sample has reached its boiling point.

In certain aspects, the feed's hydrocarbon comprises ≥10.0 wt. %, e.g., ≥50.0 wt. %, such as ≥90.0 wt. % (based on the weight of the hydrocarbon) of one or more of naphtha, gas oil, vacuum gas oil, waxy residues, atmospheric residues, residue admixtures, or crude oil; including those comprising ≥ about 0.1 wt. % asphaltenes. When the hydrocarbon includes crude oil and/or one or more fractions thereof, the crude oil is optionally desalted prior to being included in the feed. An example of a crude oil fraction utilized in the feed is produced by separating atmospheric pipestill ("APS") bottoms from a crude oil and followed by vacuum pipestill ("VPS") treatment of the APS bottoms. Suitable crude oils include, e.g., high-sulfur virgin crude oils, such as those rich in polycyclic aromatics. For example, the feed's hydrocarbon can include ≥90.0 wt. % of one or more crude oils and/or one or more crude oil fractions, such as those obtained from an atmospheric APS and/or VPS; waxy residues; atmospheric residues; naphthas contaminated with crude; various residue admixtures; and SCT.

Optionally, the feed's hydrocarbon comprises sulfur, e.g., ≥0.1 wt. % sulfur based on the weight of the feed's hydrocarbon, e.g., ≥1.0 wt. %, such as in the range of about 1.0 wt. % to about 5.0 wt. %. Optionally, at least a portion of the feed's sulfur-containing molecules, e.g., ≥10.0 wt. % of the feed's sulfur-containing molecules, contain at least one aromatic ring ("aromatic sulfur").

In certain aspects, the feed's composition varies as a function of time, e.g., by utilizing a feed having a first hydrocarbon during a first time period and then, during a second time period, substituting for at least a portion of the first hydrocarbon a second hydrocarbon. The first and second hydrocarbons can be substantially different hydrocarbons or substantially different hydrocarbon mixtures. The first and second periods can be of substantially equal duration, but this is not required. Alternating first and second periods can be conducted in sequence continuously or semi-continuously (e.g., in "blocked" operation) if desired. This can be utilized for the sequential pyrolysis of incompatible first and second hydrocarbon components (i.e., where the first and second hydrocarbon components are mixtures that are not sufficiently compatible to be blended under ambient conditions). For example, the feed can comprise a first hydrocarbon during a first time period and a second hydrocarbon (one that is substantially incompatible with the first hydrocarbon) during a second time period.

Vapor-liquid separators can be utilized for upgrading the feed before exposing it to pyrolysis conditions in the furnace's radiant section. Optionally, the pyrolysis furnace has at least one vapor/liquid separation device (sometimes referred to as flash pot or flash drum) integrated therewith. It can be desirable to integrate a vapor-liquid separator with the pyrolysis furnace when the feed's hydrocarbon comprises ≥1.0 wt. % of non-volatiles, e.g., ≥5.0 wt. %, such as 5.0 wt. % to 50.0 wt. % of non-volatiles having a nominal boiling point ≥1400° F. (760° C. The boiling point distribution and nominal boiling points of the feed's hydrocarbon are measured by Gas Chromatograph distillation (GCD) according to the methods described in ASTM D-6352-98 or D-2887, extended by extrapolation for materials having a boiling point at atmospheric pressure ("atmospheric boiling point") 700° C. (1292° F.). It is particularly desirable to integrate a vapor/liquid separator with the pyrolysis furnace when the non-volatiles comprise asphaltenes, such as feed's hydrocarbon comprises ≥ about 0.1 wt. % asphaltenes based on the weight of the feed's hydrocarbon component, e.g., ≥ about 5.0 wt. %. Conventional vapor/liquid separation devices can be utilized to do this, though the invention is not limited thereto. Examples of such conventional vapor/liquid separation devices include those disclosed in U.S. Pat. Nos. 7,138,047; 7,090,765; 7,097,758; 7,820,035; 7,311,746; 7,220,887; 7,244,871; 7,247,765; 7,351,872; 7,297,833; 7,488,459; 7,312,371; 6,632,351; 7,578,929; and 7,235,705, which are incorporated by reference herein in their entirety.

An advantage obtained when utilizing a vapor/liquid separator integrated with the pyrolysis furnace is an increase in the range of hydrocarbon types available to be used directly, without pretreatment, as hydrocarbon components in the feed. For example, the feed's hydrocarbon component can comprise ≥50.0 wt. %, e.g., ≥75.0 wt. %, such as ≥90.0 wt. % (based on the weight of the feed's hydrocarbon) of one or more crude oils, even high naphthenic acid-containing crude oils and fractions thereof. Feeds having a high naphthenic acid content are among those that produce a high quantity of SCT and are especially suitable when at least one vapor/liquid separation device is integrated with the pyrolysis furnace.

When the feed's diluent comprises steam, the pyrolysis can be carried out under conventional steam cracking conditions. Suitable steam cracking conditions include, e.g., exposing the feed to a temperature (measured at the radiant outlet) ≥400° C., e.g., in the range of 400° C. to 900° C., and a pressure ≥0.1 bar, for a cracking residence time period in the range of from about 0.01 second to 5.0 second. In certain aspects, the feed comprises hydrocarbon and diluent, wherein a. the feed's hydrocarbon comprises ≥50.0 wt. % based on the weight of the feed's hydrocarbon of one or more of one or more crude oils and/or one or more crude oil fractions, such as those obtained from an APS and/or VPS; waxy residues; atmospheric residues; naphthas contaminated with crude; various residue admixtures; and SCT; and
b. the feed's diluent comprises, e.g., ≥95.0 wt. % water based on the weight of the diluent, wherein the amount of diluent in the feed is in the range of from about 10.0 wt. % to 90.0 wt. %, based on the weight of the feed.

In these aspects, the steam cracking conditions generally include one or more of (i) a temperature in the range of 760° C. to 880° C.; (ii) a pressure in the range of from 1.0 to 5.0 bar (absolute), or (iii) a cracking residence time in the range of from 0.10 to 2.0 seconds.

A effluent is conducted away from the pyrolysis furnace, the effluent being derived from the feed by the pyrolysis. When utilizing the specified feed and pyrolysis conditions of any of the preceding aspects, the effluent generally comprises ≥1.0 wt. % of $C_2$ unsaturates and ≥0.1 wt. % of TH, the weight percents being based on the weight of the effluent. Optionally, the effluent comprises ≥5.0 wt. % of $C_2$ unsaturates and/or ≥0.5 wt. % of TH, such as ≥1.0 wt. % TH. Although the effluent generally contains a mixture of the desired light olefins, SCN, SCGO, SCT, and unreacted components of the feed (e.g., water in the case of steam cracking, but also in some cases unreacted hydrocarbon), the relative amount of each of these generally depends on, e.g., the feed's composition, pyrolysis furnace configuration, process conditions during the pyrolysis, etc. The effluent is generally conducted away for the pyrolysis section, e.g., for separation of (i) a vapor phase comprising, e.g., one or more of molecular hydrogen, $C_{4-}$ hydrocarbon (saturated and unsaturated), water, etc. and (ii) a liquid phase comprising one or more of SCN, SCGO, SCT, etc. SCT is separated from the liquid phase, e.g., as tar knock-out drum bottoms and/or primary fractionator bottoms, with the SCT being conducted away from the steam cracker for further processing.

Steam Cracker Tar

The pyrolysis tar can be SCT, e.g., SCT having a TH content ≥1.0 wt. %, e.g., in the range of from 5.0 wt. % to 40.0 wt. %, based on the weight of the SCT. Optionally, the SCT has one or more of (i) a density at 15° C. ≥1.0 g/cm$^3$, e.g., in the range of 1.01 g/cm$^3$ to 1.15 g/cm$^3$, such as in the range of 1.07 g/cm$^3$ to 1.15 g/cm$^3$; and (ii) a 50° C. viscosity in the range of 200 cSt to $1.0\times10^7$ cSt. The amount of olefin the SCT is generally ≤10.0 wt. %, e.g., ≤5.0 wt. %, such as ≤2.0 wt. %, based on the weight of the SCT. More particularly, the amount of (i) vinyl aromatics in the SCT and/or (ii) aggregates in the SCT which incorporate vinyl aromatics is generally ≤5.0 wt. %, e.g., ≤3 wt. %, such as ≤2.0 wt. %, based on the weight of the SCT. The invention is compatible with an SCT having a relatively high sulfur content, e.g., ≥0.1 wt. %, based on the weight of the SCT, such as ≥1.0, or ≥2.0 wt. %, or in the range of 0.5 wt. % to 7.0 wt. %. High sulfur content is not required, and relatively low sulfur-content SCT can be used, e.g., SCT having a sulfur content ≤0.1 wt. %, based on the weight of the SCT, e.g., ≤0.05 wt. %, such as ≤0.01 wt. %.

The SCT comprises TH, e.g., ≥50.0 wt. % of the effluent's TH based on the weight of the effluent's TH, such as ≥90.0 wt. %. The TH can include high-molecular weight molecules (e.g., MW≥600) such as asphaltenes and other high-molecular weight hydrocarbon. For example, the TH can comprise ≥10.0 wt. % of high molecular-weight molecules having aromatic cores that are linked together by one or more of (i) relatively low molecular-weight alkanes and/or alkenes, e.g., $C_1$ to $C_3$ alkanes and/or alkenes, (ii) $C_5$ and/or $C_6$ cycloparaffinic rings, or (iii) thiophenic rings. Generally, ≥60.0 wt. % of the TH's carbon atoms are included in one or more aromatic cores based on the weight of the TH's carbon atoms, e.g., in the range of 68.0 wt. % to 78.0 wt. %. In certain aspects, the effluent's TH comprise ≥10.0 wt. % of TH aggregates having an average size in the range of 10.0 nm to 300.0 nm in at least one dimension and an average number of carbon atoms ≥50, the weight percent being based on the weight of TH in the effluent. Generally, the aggregates comprise ≥50.0 wt. %, e.g., ≥80.0 wt. %, such as ≥90.0 wt. % of TH molecules having a C:H atomic ratio in the range of from 1.0 to 1.8, a molecular weight in the range of 250 to 5000, and a melting point in the range of 100° C. to 700° C.

SCT differs from other relatively high-molecular weight hydrocarbon mixtures, such as crude oil residue ("resid") including both atmospheric and vacuum resids and other streams commonly encountered, e.g., in petroleum and petrochemical processing. Some of these differences are disclosed in one or more of the following U.S. Patent Application Publications, each of which is incorporated by reference herein in its entirety: U.S. 2014-0061094 A1, 2014-0061096A1, 2014-0061100A1, 2014-0061095A1, and 2013-0233764A1. For example, the amount of aromatic carbon in SCT typically is greater than 70 wt. % while the amount of aromatic carbon in resid is generally less than 40 wt. %.

SCT (and the hydroprocessed product derived therefrom) comprise to a large extent a mixture of multi-ring compounds. The rings can be aromatic or non-aromatic and can contain a variety of substituents and/or heteroatoms. For example, the hydroprocessed product can contain, e.g., ≥10.0 wt. %, or ≥20.0 wt. %, or ≥30.0 wt. %, based on the weight of the hydroprocessed product, of aromatic and non-aromatic multi-ring compounds. Non aromatic rings, present in SCT and the hydroprocessed product derived therefrom, are primarily six and five member non-aromatic rings, e.g., ≥50.0 wt. % of the non-aromatic rings present in the SCT (or hydroprocessed product) are six or five member non-aromatic rings, based on the weight of non-aromatic rings present in the SCT or hydroprocessed product as the case may be.

When (i) the feed's hydrocarbon is a crude oil or crude oil fraction comprising ≥0.1 wt. % of aromatic sulfur and (ii) the pyrolysis is steam cracking, then the SCT contains a significant amount of sulfur derived from the feed's aromatic sulfur. For example, the SCT sulfur content can be about 3 to 4 times higher in the SCT than in the feed's hydrocarbon component, on a weight basis. It has been found that including sulfur and/or sulfur-containing molecules in the feed lessens the amount of olefinic unsaturation (and the total amount of olefin) present in the SCT. For example, when the feed's hydrocarbon comprises sulfur, e.g., ≥0.1 wt. % sulfur based on the weight of the feed's hydrocarbon, e.g., ≥1.0 wt. %, such as in the range of about 1.0 wt. % to about 5.0 wt. %, then the amount of olefin contained in the SCT is ≤10.0 wt. %, e.g., ≤5.0 wt. %, such as ≤2.0 wt. %, based on the weight of the SCT. More particularly, the amount of (i) vinyl aromatics in the SCT and/or (ii) aggregates in the SCT which incorporate vinyl aromatics is ≤5.0 wt. %, e.g., ≤3 wt. %, such as ≤2.0 wt. %. While not wishing to be bound by any theory or model, it is believed that the amount of olefin in the SCT is lessened because the presence of feed sulfur leads to an increase in amount of sulfur-containing hydrocarbon molecules in the effluent. Such sulfur-containing molecules can include, for example, one or more of mercaptans; thiophenols; thioethers, such as heterocyclic thioethers (e.g., dibenzosulfide; thiophenes, such as benzothiophene and dibenzothiophene, etc.). The formation of these sulfur-containing hydrocarbon molecules is believed to lessen the amount of amount of relatively high molecular weight olefinic molecules (e.g., $C_{6+}$ olefin) produced during and after the pyrolysis, which results in fewer vinyl aromatic molecules available for inclusion in SCT, e.g., among the SCT's TH aggregates. In other words, when the feedstock includes sulfur, the pyrolysis favors the formation in the SCT of sulfur-containing hydrocarbon, such as $C_{6+}$ mercaptan, over $C_{6+}$ olefins such as vinyl aromatics.

In aspects which include integrating at least one vapor-liquid separator with the steam cracking furnace, the amount of $C_{6+}$ olefin in the SCT is lessened, particularly when the feed's hydrocarbon has a relatively high asphaltene content and a relatively low sulfur content. Such hydrocarbons include, for example, those having (i) ≥ about 0.1 wt. % asphaltenes based on the weight of the feed's hydrocarbon component, e.g., ≥ about 5.0 wt. %; (ii) a final boiling point ≥600° F. (315° C.), generally ≥950° F. (510° C.), or ≥1100° F. (590° C.), or ≥1400° F. (760° C.); and optionally (iii) ≤5 wt. % sulfur, e.g., ≤1.0 wt. % sulfur, such as ≤0.1 wt. % sulfur. It is observed that utilizing an integrated vapor-liquid separator when pyrolysing these hydrocarbons in the presence of steam, the amount of olefin the SCT is ≤10.0 wt. %, e.g., ≤5.0 wt. %, such as ≤2.0 wt. %, based on the weight of the SCT. More particularly, the amount of (i) vinyl aromatics in the SCT and/or (ii) aggregates in the SCT which incorporate vinyl aromatics is ≤5.0 wt. %, e.g., ≤3.0 wt. %, such as ≤2.0 wt. %. The amount of sulfur in such SCT can be ≤0.1 wt. %, based on the weight of the SCT, e.g., ≤0.05 wt. %, such as ≤0.01 wt. %. While not wishing to be bound by any theory or model, it is believed that the amount of olefin in the SCT is lessened because precursors in the feed's hydrocarbon that would otherwise form $C_{6+}$ olefin in the SCT are separated from the feed in the vapor-liquid separator and conducted away from the process before the pyrolysis. Evidence of this feature is found by comparing the density of SCT obtained by crude oil pyrolysis. For conventional steam cracking of a crude oil fraction, such as vacuum gas oil, the SCT is observed to have an API gravity (measured at 15.6° C.) the range of about −1° API to about 6° API. API gravity is an inverse measure of the relative density, where a lesser (or more negative) API gravity value is an indication of greater SCT density. When the same hydrocarbon is pyrolysed utilizing an integrated vapor-liquid separator operating under the specified conditions, the SCT density is increased, e.g., to an API gravity ≤−7.5° API, such as ≤−8.0° API, or ≤−8.5° API.

Hydroprocessing Catalyst

SCT can be hydroprocessed utilizing one or more hydroprocessing catalysts (the "catalyst"), in the presence of treat gas and the specified utility fluid. At the start of the process, a volume of fresh or freshly-regenerated catalyst is transferred to at least one reaction zone in a hydroprocessing reactor. Before starting hydroprocessing, it is conventional to activate the catalyst. Conventional catalyst activation technology can be utilized to do this, but the invention is not limited thereto. Aspects of the invention relating to fixed-bed hydroprocessing of SCT will now be described in more detail, The invention is not limited to these aspects, and this description is not meant to foreclose other aspects within the broader scope of the invention, such as those which include the hydroprocessing of other types of pyrolysis tar and/or those which include hydroprocessing without a fixed bed of hydroprocessing catalyst. Conventional hydroprocessing catalyst can be utilized for SCT hydroprocessing in the presence of utility fluid, but the invention is not limited thereto. Suitable hydroprocessing catalysts are disclosed, e.g., in U.S. Patent Application Publication No. 2014/006100. In certain aspects, the hydroprocessing catalyst includes one or more catalyst specified for use in fuel and lube hydroprocessing, such as diesel hydroprocessing, FCC feed hydroprocessing, resid hydroprocessing, and/or heavy oil hydroprocessing. For example, the hydroprocessing catalyst can comprise (i) one or more bulk metals and/or (ii) one or more metals on a support. The metals can be in elemental form or in the form of a compound. The hydroprocessing catalyst generally includes at least one metal from any of Groups 5 to 10 of the Periodic Table. Examples of such catalytic metals include, but are not limited to, vanadium, chromium, molybdenum, tungsten, manganese, technetium, rhenium, iron, cobalt, nickel, ruthenium, palladium, rhodium, osmium, iridium, platinum, or mixtures thereof. Conventional hydrotreating catalysts can be used, such as those containing one or more of cobalt, nickel, or molybdenum, but the invention is not limited thereto. In certain aspects, the catalysts include one or more of KF860 available from Albemarle Catalysts Company LP, Houston Tex.; Nebula® Catalyst, such as Nebula® 20, available from the same source; Centera® catalyst, available from Criterion Catalysts and Technologies, Houston Tex., such as one or more of DC-2618, DN-2630, DC-2635, and DN-3636; Ascent® Catalyst, available from the same source, such as one or more of DC-2532, DC-2534, and DN-3531; and FCC pretreat catalyst, such as DN3651 and/or DN3551, available from the same source.

Catalyst Activation

In certain aspects, a volume of fresh or freshly-regenerated catalyst is transferred to at least one reaction zone in a hydroprocessing reactor. It is conventional to activate the catalyst before the start of hydroprocessing. Activation converts the catalyst from oxide or reduced form to a form, generally a sulfide form, which is more active and/or selective for hydroprocessing. For example, a fresh catalyst in oxide form that is located in a fixed bed of a hydroprocessing zone can be activated by an activator, the activator being conveyed to the hydroprocessing zone by a carrier fluid. The carrier fluid can be introduced into the hydroprocessing reactor via the reactor's inlet. Generally, the activator, carrier fluid, and activating fluid are at least partially in the liquid phase during activation, and in certain aspects substantially all of the activator and carrier fluid (e.g., substantially all of the activating fluid) are in the liquid phase during activation.

Typically, activation is carried out by contacting the catalyst with an activating fluid in the presence of molecular hydrogen under catalyst activation conditions, wherein (i) the activating fluid comprises carrier fluid and activator and (ii) the activator is present in an amount effective for activating the catalyst. Molecular hydrogen can be provided as one component of a treat gas, e.g., a treat gas of substantially the same composition as that used during SCT hydroprocessing. Catalyst activation conditions generally include a temperature in the range of from about 120° C. to about 200° C. and a pressure in the range of about 10 bar gauge to about 100 bar gauge. As will be appreciated by those skilled in the art, activation is carried out for a time sufficient to convert the catalyst from oxide form to sulfide form, without significant reduction of the catalytic metal.

Conventional activators can be utilized, but the invention is not limited thereto. Suitable activators include one or more of hydrocarbon-sulfides, hydrocarbon-sulfoxides, and hydrocarbon-polysulfides, e.g., one or more alkylsulfides, alkylsulfoxides, and alkylpolysulfides. Preferred activators include one or more of methylsulfide, ethylsulfide, methyldisulfide, ethyldisulfide, dimethylsulfide, diethylsulfide, dimethyldisulfide, dimethylsulfoxide, tert-butyl polysulfide, and di-tert-butyl polysulfide. It is believed that during activation the activator(s) react with molecular hydrogen to form hydrogen sulfide proximate to the catalytic metal. It is believed that the hydrogen sulfide reacts with the catalytic metal to form metallic sulfide on or in the catalyst.

A carrier fluid can be utilized for conveying the activator to the catalyst. In order to avoid consuming additional molecular hydrogen during catalyst activation, which might suppress the yield of the desired hydrogen sulfide molecules, it is desirable that the carrier fluid contain ≤10.0 wt. % aromatics, based on the weight of the carrier fluid, e.g., ≤1.0 wt. %, or ≤0.1 wt. %. Generally, the carrier fluid comprises (i) ≥90.0 wt. % of paraffin, based on the weight of the carrier fluid, e.g., ≥95.0 wt. %, such as ≥99.0 wt. %, and (ii) ≤10.0 wt. % or aromatics, e.g., ≤5.0 wt. %, such as ≤1.0 wt. %. Suitable carrier fluids include paraffinic lubricating oil base stock, such as 130N lubricating oil base stock.

Those skilled in the art will appreciate that the amount of activator present during catalyst activation will generally exceed the minimum amount of sulfur needed to completely sulfide the catalytic metal. Doing so is believed to lessen the risk of reducing the catalytic metal during activation. The amount of activator in the activating fluid is generally ≥5.0 wt. %, e.g., ≥10.0 wt. %, such as ≥15.0 wt. %, based on the weight of the activating fluid.

The amount of activator can be selected to achieve a total amount of sulfur in the activating fluid is ≥1% on a weight basis, e.g., ≥2%, such as ≥5%. The balance of the activating fluid can be carrier fluid. In certain aspects, the activating fluid comprises 10.0 wt. % to 30.0 wt. % of activator and 70.0 wt. % to 90.0 wt. % carrier fluid, e.g., 15.0 wt. % to 25.0 wt. % of activator and 75.0 wt. % to 85.0 wt. % of carrier fluid.

Conventional catalyst activation conditions can be utilized, although the invention is not limited thereto, e.g., exposing the catalyst to a temperature ≥200° C. In certain aspects utilizing a supported catalyst comprising cobalt and molybdenum, activation is carried out at a temperature ≥450° F. (≥232° C.). In certain aspects utilizing a supported catalyst comprising nickel and molybdenum, activation is carried out at a temperature ≥400° F. (≥204° C.). Reactor pressure during activation is generally ≥100 psig (690 kPa g), e.g., ≥500 psig (3447 kPa g), such as in the range of from about 700 psig (4826 kPa g) to about 1000 psig (6900 kPa g). Those skilled in the art will appreciate that molecular hydrogen flow rate during activation should be greater than the minimum amount need to produce hydrogen sulfide proximate to the catalyst. In certain aspects the molecular hydrogen flow rate ("$H_2$ FR") during activation (volume per unit time) is greater than or equal to the activating fluid flow rate ("AF FR") during activation (volume per unit time), e.g., $H_2$ FR is ≥2.0 AF FR, such as $H_2$ FR is ≥4.0 AF FR.

Activation is generally carried out for a time duration sufficient to convert substantially all of the catalytic metal to sulfide form. For example, the duration of activation can be ≥4 hours, such as ≥8 hours, or even ≥12 hours. The activator, carrier fluid, and activating fluid all can be primarily in the liquid phase during activation, e.g., ≥90.0 wt. %, such as ≥99 wt. % in the liquid phase, based on the weight of the activator, carrier fluid, or activating fluid as the case may be.

At least a portion of the activated catalyst can be utilized for hydroprocessing SCT in the presence of utility fluid. Aspects of utility fluids suitable for SCT hydroprocessing with the activated catalyst will now be described in more detail. The invention is not limited to these aspects, and this description is not meant to foreclose the use of other utility fluids within the broader scope of the invention, e.g., with other pyrolysis tars and/or with other hydroprocessing catalysts.

Utility Fluid

In certain aspects, the utility fluid comprises aromatics, e.g., ≥70.0 wt. % aromatics, based on the weight of the utility fluid, such as ≥80.0 wt. %, or ≥90.0 wt. %. Typically, the utility fluid comprises ≤10.0 wt. % of paraffin, based on the weight of the utility fluid. For example, the utility fluid can comprise ≥95.0 wt. % of aromatics, ≤5.0 wt. % of paraffin. Optionally, the utility fluid has a final boiling point ≤750° C. (1400° F.), e.g., ≤570° C. (1050° F.), such as ≤430° C. (806° F.). Such utility fluids can comprise ≥25.0 wt. % of 1-ring and 2-ring aromatics (i.e., those aromatics having one or two rings and at least one aromatic core), based on the weight of the utility fluid. Utility fluids having a relatively low final boiling point can be used, e.g., a utility fluid having a final boiling point ≤400° C. (750° F.). The utility fluid can have an 10% (weight basis) total boiling point ≥120° C., e.g., ≥140° C., such as ≥150° C. and/or a 90% total boiling point ≤430° C., e.g., ≤400° C. Suitable utility fluids include those having a true boiling point distribution generally in the range of from 175° C. (350° F.) to about 400° C. (750° F.). A true boiling point distribution can be determined, e.g., by conventional methods such as the method of A.S.T.M. D7500.

The utility fluid typically comprises aromatics, e.g., ≥95.0 wt. % aromatics, such as ≥99.0 wt. %. For example, the utility fluid comprises ≥95.0 wt. % based on the weight of the utility fluid of one or more of benzene, ethylbenzene, trimethylbenzene, xylenes, toluene, naphthalenes, alkylnaphthalenes (e.g., methylnaphtalenes), tetralins, or alkyltetralins (e.g., methyltetralins), e.g., ≥99.0 wt. %, such as ≥99.9 wt. %. It is generally desirable for the utility fluid to be substantially free of molecules having alkenyl functionality, particularly in aspects utilizing a hydroprocessing catalyst having a tendency for coke formation in the presence of such molecules. In certain aspects, the supplemental utility fluid comprises ≤10.0 wt. % of ring compounds having $C_1$-$C_6$ sidechains with alkenyl functionality, based on the weight of the utility fluid.

Certain solvents and solvent mixtures can be used as utility fluid, including SCN, SCGO, and/or other solvent comprising aromatics, such as those solvents comprising ≥90.0 wt. %, e.g., ≥95.0 wt. %, such as ≥99.0 wt. % of aromatics, based on the weight of the solvent. Representative aromatic solvents that are suitable for use as utility fluid include A200 solvent, available from ExxonMobil Chemical Company (Houston Tex.), CAS number 64742-94-5.

Utilizing a utility fluid comprising solvent or comprising a solvent mixture can be particularly beneficial at the start of SCT hydroprocessing, especially before the SCT processing produces a steady-state effluent from which a utility fluid can be derived and recycled for combining with SCT. The term "primer fluid" means a utility fluid utilized at the start of SCT hydroprocessing. Typically, primer fluid comprises solvent or a mixture of solvents. Besides its use at the start of SCT hydroprocessing, primer fluid can also be used as a second utility fluid, which can be introduced into the hydroprocessing reactor to lessen reactor pressure drop.

Although any of the specified utility fluids can be utilized as primer fluid, in certain aspects the primer fluid comprises (i) ≥75.0 wt. % of aromatics having from one to four rings, e.g., ≥90.0 wt. % of single-ring aromatics, such as those having one or more hydrocarbon substituents, and (ii) ≤0.1 wt. % sulfur. The single-ring aromatics can have, e.g., from 1 to 3 or 1 to 2 hydrocarbon substituents. Such substituents can be any hydrocarbon group that is consistent with the overall solvent distillation characteristics. Examples of such hydrocarbon groups include, but are not limited to, those selected from the group consisting of $C_1$-$C_6$ alkyl, wherein the hydrocarbon groups can be branched or linear and the hydrocarbon groups can be the same or different. Optionally, the primer fluid comprises ≥90.0 wt. %, based on the weight of the primer fluid, of one or more of benzene, ethylbenzene, trimethylbenzene, xylenes, toluene, naphthalenes, alkylnaphthalenes (e.g., methylnaphtalenes), tetralins, or alkyltetralins (e.g., methyltetralins). In particular aspects, the primer fluid comprises one or more of benzene, toluene, naphthalene, phenanthrene, triphenylene, pyrene, and alkylated variations thereof. Representative primer fluids are disclosed in Provisional U.S. Patent Application No. 61/986,316, which is incorporated by reference herein in its entirety.

After SCT hydroprocessing is operating in the steady-state, under specified SCT hydroprocessing conditions, at least a portion of the utility fluid can be obtained from the hydroprocessed product, e.g., by separating and re-cycling a portion of the hydroprocessed product. Methods for obtaining a suitable utility fluid from the hydroprocessed product are disclosed, e.g., in U.S. Patent Application Publication No. 2014-0061096 and in Provisional U.S. Patent Application No. 61/986,316. When utilizing a utility fluid that is obtained at least in part from the hydroprocessed product, a portion thereof can be stored for later use. The stored utility fluid can be used, e.g., a primer fluid when re-starting SCT hydroprocessing after a shut-down and/or when starting a second SCT hydroprocessor. Should the amount of utility fluid derived from the process be insufficient for producing an SCT-utility fluid mixture of the specified relative amounts of SCT and utility fluid, additional utility fluid can be obtained from supplemental source ("supplemental utility fluid"). The supplemental utility fluid can comprise one or more of the specified solvents or solvent mixtures, primer fluid, and stored utility fluid.

The relative amounts of utility fluid and SCT during hydroprocessing are generally in the range of from about 20.0 wt. % to about 95.0 wt. % of the SCT and from about 5.0 wt. % to about 80.0 wt. % of the utility fluid, based on total weight of utility fluid plus SCT. For example, the relative amounts of utility fluid and SCT can be in the range of (i) about 20.0 wt. % to about 90.0 wt. % of the SCT, e.g., about 40.0 wt. % to about 90.0 wt. %, and about 10.0 wt. % to about 80.0 wt. % of the utility fluid, e.g., about 10.0 wt. % to about 60.0 wt. % of the utility. In certain aspects, the combined SCT+utility fluid has a utility fluid:SCT weight ratio ≥0.01, e.g., in the range of 0.05 to 4.0, such as in the range of 0.1 to 3.0, or 0.3 to 1.1. At least a portion of the utility fluid can be combined with at least a portion of the SCT within the hydroprocessing vessel or hydroprocessing zone, but this is not required, and in certain aspects at least a portion of the utility fluid and at least a portion of the SCT are supplied as separate streams and combined into one stream prior to entering, e.g., upstream of the hydroprocessing stage(s). The relative amount of primer fluid and SCT during start-up can be substantially the same as the relative amounts of utility fluid and SCT during SCT hydroprocessing.

The temperature and pressure of the hydroprocessing conditions should be selected with consideration of the boiling point of the solvent. Preferably, the solvent should be in liquid phase but at high enough temperature to increase the tar molecule solvency. Higher temperatures and lower pressures are not preferred as significant solvent hydrogenation can occur.

Hydroprocessing

SCT hydroprocessing in the presence of the utility fluid can be carried out in one or more hydroprocessing stages, the stages comprising one or more hydroprocessing vessels or zones. Vessels and/or zones within the hydroprocessing stage in which catalytic hydroprocessing activity occurs generally include at least one of the specified hydroprocessing catalyst. The catalysts can be mixed or stacked, such as when the catalyst is in the form of one or more fixed beds in a vessel or hydroprocessing zone.

The hydroprocessing is carried out in the presence of molecular hydrogen, e.g., by (i) combining molecular hydrogen with the SCT and/or utility fluid upstream of the hydroprocessing and/or (ii) conducting molecular hydrogen to the hydroprocessing stage in one or more conduits or lines. Although relatively pure molecular hydrogen can be utilized for the hydroprocessing, it is generally desirable to utilize a "treat gas" which contains sufficient molecular hydrogen for the hydroprocessing and optionally other species (e.g., nitrogen and light hydrocarbons such as methane) which generally do not adversely interfere with or affect either the reactions or the products. Unused treat gas can be separated from the hydroprocessed product for re-use, generally after removing undesirable impurities, such as $H_2S$ and $NH_3$. The treat gas optionally contains ≥ about 50 vol. % of molecular hydrogen, e.g., ≥ about 75 vol. %, based on the total volume of treat gas conducted to the hydroprocessing stage.

Optionally, the amount of molecular hydrogen supplied to the hydroprocessing stage is ≥75 S $m^3/m^3$ (standard $m^3$ of molecular hydrogen per $m^3$ of (SCT plus utility fluid)). Optionally, the amount of molecular hydrogen is in the range of from about 300 SCF/B (standard cubic feet per barrel of (SCT+utility fluid)) (53 S $m^3/m^3$) to 5000 SCF/B (890 S $m^3/m^3$), such as 1000 SCF/B (178 S $m^3/m^3$) to 3000 SCF/B (534 S $m^3/m^3$). Hydroprocessing the SCT in the presence of the specified utility fluid, molecular hydrogen, and a catalytically effective amount of the specified hydroprocessing catalyst under catalytic hydroprocessing conditions produces a hydroprocessed product including, e.g., upgraded SCT. An example of suitable catalytic hydroprocessing conditions will now be described in more detail. The invention is not limited to these conditions, and this description is not meant to foreclose other hydroprocessing conditions within the broader scope of the invention.

SCT hydroprocessing is generally carried out under hydroconversion conditions, e.g., under conditions for carrying out one or more of hydrocracking (including selective hydrocracking), hydrogenation, hydrotreating, hydrodesulfurization, hydrodenitrogenation, hydrodemetallation, hydrodearomatization, hydroisomerization, or hydrodewaxing. The hydroprocessing reaction can be carried out in at least one vessel or zone that is located, e.g., within a hydroprocessing stage downstream of the pyrolysis stage and separation stage. The specified SCT contacts the hydroprocessing catalyst in the vessel or zone, in the presence of the utility fluid and molecular hydrogen. Catalytic hydroprocessing conditions can include, e.g., exposing the combined (SCT+utility fluid) mixture to a temperature in the range from 50° C. to 500° C., or from 200° C. to 450° C., or from 220° C. to 430° C., or from 350° C. to 420° C. proximate to the molecular hydrogen and hydroprocessing catalyst. For example, a temperature in the range of from 300° C. to 500° C., or 350° C. to 430° C. can be utilized. Liquid hourly space velocity (LHSV) of the combined SCT+utility fluid volume per volume of catalyst can be ≥0.1 $h^{-1}$, e.g., in the range of from 0.1 $h^{-1}$ to 30 $h^{-1}$, or 0.4 $h^{-1}$ to 25 $h^{-1}$, or 0.5 $h^{-1}$ to 20 $h^{-1}$. In certain aspects, LHSV is at least 5 $h^{-1}$, or at least 10 $h^{-1}$, or at least 15 $h^{-1}$. In other aspects, LHSV is in the range of from 0.1 to 2.0, e.g., 0.25 to 0.50. Molecular hydrogen partial pressure during the hydroprocessing is generally in the range of from 0.1 MPa to 8 MPa, or 1 MPa to 7 MPa, or 2 MPa to 6 MPa, or 3 MPa to 5 MPa. In certain aspects, the partial pressure of molecular hydrogen is ≤7 MPa, or ≤6 MPa, or ≤5 MPa, or ≤4 MPa, or ≤3 MPa, or ≤2.5 MPa, or ≤2 MPa. Total pressure during the hydroprocessing is generally ≥10 bar gauge, e.g., in the range of 15 bar(g) to 135 bar(g), or 20 bar(g) to 120 bar(g), or 20 bar(g) to 100 bar(g). Molecular hydrogen consumption rate is based on the volume of molecular hydrogen per volume of SCT. Generally, molecular hydrogen consumption rate is in the range of about 53 standard cubic meters/cubic meter (S $m^3/m^3$) (300 SCF/B) to 1767 S $m^3/m^3$ (10,000 SCF/B), e.g., 148 S $m^3/m^3$ (835 SCF/B) to 1180 S $m^3/m^3$ (6680 SCF/B), such as 177 S $m^3/m^3$ (1000 SCF/B) to 442 S $m^3/m^3$ (2500 SCF/B). In particular aspects, the hydroprocessing conditions include one or more of a temperature in the range of 360° C. to 430° C., e.g., 375° C. to 425° C., such as 385° C. to 415° C.; a pressure in the range of 47 bar(g) (700 psig) to 133 bar(g) (2000 psig), e.g., 60 bar(g) (900 psig) to 87 bar(g) (1300 psig), a molecular hydrogen consumption rate in the range of 148 S $m^3/m^3$ (835 SCF/B) to 1180 S $m^3/m^3$ (6680 SCF/B), e.g., 177 S $m^3/m^3$ (1000 SCF/B) to 442 S $m^3/m^3$ (2500 SCF/B); and an LHSV in the range of from 0.1 to 2.0, e.g., 0.25 to 0.50. When operated under these conditions using the specified catalyst, TH conversion is generally ≥25.0% on a weight basis, e.g., ≥50.0%, resulting in the SCT having desirable viscosity and blending characteristics.

Effluent is conducted away from the hydroprocessor, the effluent comprising converted SCT, unconverted SCT, unconverted treat gas, utility fluid, hydrogen sulfide, etc., a vapor-phase portion is separated from the effluent and conducted away, the vapor-phase portion having a final boiling point <40° C. and comprising molecular hydrogen, hydrogen sulfide, and light hydrocarbon gasses. The remainder of the effluent can be subjected to further separations, e.g., one or more of (i) separating an aromatics-containing stream having a boiling range of about 40° C. to about 430° C., e.g., about 170° C. to about 430° C., such as about 175° C. to 430° C., or about 200° C. to about 430° C., or about 175° C. to about 400° C., or about 200° C. to about 400° C., and (ii)

a hydroprocessed SCT having a true boiling range >400° C., e.g., >430° C. At least a portion of the separated aromatics-containing stream can be recycled to the process for use as utility fluid.

Hydroprocessing Reactor Pressure Drop

It has been found that an undesirable increase in hydroprocessing reactor pressure drop can occur at one or more of (i) when starting SCT hydroprocessing following catalyst activation, (ii) when there is a substantial change in SCT composition, as might occur when there is a substantial change in the feed to the pyrolysis furnace, and (iii) after continuous SCT hydroprocessing for a relatively long time duration, even without a substantial change in SCT composition.

When initiating SCT hydroprocessing, the reactor is transitioned from a catalyst activation mode to a SCT hydroprocessing mode. During the transition, SCT and utility fluid are substituted for the activating fluid and reactor conditions can be adjusted, if needed for hydroprocessing optimization, from activating conditions to SCT hydroprocessing conditions. At the onset of SCT hydroprocessing, the activated catalyst is active and selective for SCT hydroprocessing, but the yield of desired products, e.g., hydroprocessed SCT, rapidly decreases as the transition to SCT hydroprocessing mode progresses. The decrease in yield is accompanied by an increase in hydroprocessing reactor pressure drop. It is believed that the decrease in product yield primarily results from fouling of the hydroprocessing catalyst, reactor components, and ancillary equipment, as a result of incompatibility between the carrier fluid and utility fluid. In other words, the increase in reactor pressure drop does not result primarily from the accumulation high molecular-weight, refractory SCT conversion products such as catalyst coke. Rather, the increase in reactor pressure drop primarily results from a phase separation of certain molecules in the SCT feed, and precipitation of these precipitated molecules within the reactor, the phase separation arising from the presence of incompatible carrier fluid.

It has been found that this difficulty can be overcome by modifying the transition from activation mode to SCT hydroprocessing. During the transition, utility fluid, e.g., primer fluid, is substituted for at least a portion of the activating fluid, preferably before SCT is introduced into the reactor. Optionally, substantially all of the activating fluid is replaced by the substituted utility fluid before SCT is introduced into the reactor. Optionally, the flow of molecular hydrogen to the reactor is interrupted during or before the substitution of utility fluid for the activating fluid. For example, substantially all of the treat gas flow to the reactor can be replaced by a flow of inert gas such as nitrogen, until at least a portion of the activating fluid has been replaced by utility fluid. The flow of inert gas is then curtailed, and the flow of treat gas is increased, before or during introduction of SCT into the reactor for hydroprocessing.

Accordingly, certain aspects of the invention relate to a pyrolysis tar upgrading processes, the process comprising providing a reactor zone containing catalyst, a utility fluid comprising ≥90.0 wt. % of aromatics and ≤10.0 wt. % of paraffin; a pyrolysis tar; an activating fluid, and a treat gas. The utility fluid can be any of the previously specified utility fluids, e.g., one having a final boiling point ≤430° C. (806° F.), and which comprises ≥25.0 wt. % of 1-ring and 2-ring aromatics. The treat gas can be any of the previously specified treat gases, e.g., one comprising ≥50.0 vol. % of molecular hydrogen. The activating fluid can be any of the previously specified activating fluids, e.g., one comprising carrier fluid and ≥5.0 wt. % of at least one activator, wherein the carrier fluid comprises ≥90.0 wt. % of paraffin and ≤10.0 wt. % of aromatics. The pyrolysis tar can be any of the previously specified pyrolysis tars, e.g., one comprising ≥0.1 wt. % of tar heavies and ≤5.0 wt. % of (i) vinyl aromatics and/or (ii) aggregates incorporating vinyl aromatics. In certain aspect the pyrolysis tar comprises SCT. The hydroprocessing catalyst can be any of the previously specified hydroprocessing catalysts, e.g., one comprising (i) ≥1 wt. % of one or more metals selected from Groups 6, 8, 9, and 10 of the Periodic Table and (ii) ≥1 wt. % of an inorganic oxide, the weight percents being based on the weight of the hydroprocessing catalyst.

The catalyst in the reactor zone is exposed to the treat gas and activating fluid under catalyst activation conditions, the catalyst activation conditions including an LHSV ≥0.01 $m^3$ of activating fluid per $m^3$ of the catalyst. After the catalyst is sufficiently activated the flow of activating fluid is decreased to an LHSV<0.01 $m^3$ of activating fluid per $m^3$ of the catalyst. Utility fluid is provided to the reactor at an LHSV ≥0.1 $m^3$ of utility fluid per $m^3$ of the catalyst. During this transitions stage, treat gas flow to the reactor can be lessened or substantially discontinued. After the utility fluid has swept at least a portion of the activating fluid from the reactor, pyrolysis tar is transferred to the reactor for pyrolysis tar hydroprocessing. A hydroprocessed product can be separated from the conversion product (the reactor effluent), e.g., for storage and/or further processing. Process efficiency can be improved, if desired, by obtaining at least a portion of the utility fluid from the upgrading process. For example, the process can further include substituting at least a portion of the separated hydroprocessed product for at least a portion of the utility fluid during pyrolysis tar hydroprocessing, e.g., to achieve a [(substituted hydroprocessed product+utility fluid):pyrolysis tar] weight ratio in the range of from about 0.05 to about 4.0. For example, the process can include recycling at least a portion of the hydroprocessed product, and obtaining substantially all of the utility fluid used during the hydroprocessing from the recycled hydroprocessed product, e.g., to achieve during SCT hydroprocessing a [substituted hydroprocessed product:pyrolysis tar] weight ratio in the range of from about 0.3 to 1.1.

Catalyst activation conditions can be selected from those specified in the Catalyst Activation section of this description. In certain aspects, the catalyst activation conditions include exposing the catalyst, treat gas, and activating fluid to a temperature ≥200° C. and a pressure ≥700 kPa, wherein the activator includes one or more of methylsulfide, ethylsulfide, methyldisulfide, ethyldisulfide, dimethylsulfide, diethylsulfide, dimethyldisulfide, dimethylsulfoxide, tert-butyl polysulfide, and di-tert-butyl polysulfide. The hydroprocessing can be carried out under the specified pyrolysis tar conversion conditions. In certain aspects, the pyrolysis tar conversion conditions include an LHSV ≥0.1 $m^3$ of (pyrolysis tar+utility fluid) per $m^3$ of the catalyst, a temperature ≥100° C. and a pressure ≥34 bar(g), and a utility fluid:pyrolysis tar weight ratio in the range of from about 0.05 to about 4.0. For example, the conversion conditions can include one or more of a temperature in the range of 360° C. to 425° C., a pressure in the range of 47 bar(g) to 133 bar(g), and a molecular hydrogen consumption rate of 148 S $m^3/m^3$ to 1180 S $m^3/m^3$. In certain aspects, when operating the process under the specified conditions, the reactor zone has a first pressure-drop $\Delta P_1$ at the start of catalyst activation and a second pressure-drop $\Delta P_2$ during pyrolysis tar hydroprocessing, wherein $\Delta P_1$ is ≤3.4 bar(g) and $\Delta P_2$ is ≤14 bar(g) for at least $8.6\times10^4$ seconds (approximately 24 hours) after the start of pyrolysis tar hydroprocessing. For example, $\Delta P_2$ can be ≤10 bar(g) for at least $8.6\times10^4$ seconds after the start of pyrolysis tar hydroprocessing.

It has been observed that when operating the pyrolysis tar upgrading process for ≥1 day, or ≥1 week, or even ≥1 month, reactor pressure drop will gradually increase to an unacceptable level. Each reactor will have a predetermined amount of pressure drop that is considered unacceptable, as evidenced by, e.g., a diminished recovery rate of hydroprocessed tar. Typically, reactor pressure drop is considered to be unacceptable when it is ≥3.4 bar(g), e.g., ≥4 bar(g), such as ≥6 bar(g). It has also been observed that reactor pressure drop can increase when there is a significant change in pyrolysis tar composition. For instance, if the first pyrolysis tar differs from a second pyrolysis tar by greater than or equal to a 10% in difference in carbon content, sulfur content, hydrogen content, boiling points, asphaltene content, or kinematic viscosity. Reactor pressure drop can also increase after a significant change in hydroprocessing process conditions, e.g., a change in treat gas flow rate, reactor temperature, reactor pressure, etc. It has been found that introducing a second utility fluid, e.g., the specified primer fluid, into the reactor can be used to lessen the reactor pressure drop.

Accordingly, certain aspects of the invention relate to a process for hydroprocessing pyrolysis tar that mitigates fouling induced reactor pressure drop. The process comprises two steps. The first step is hydroprocessing a feed comprising pyrolysis tar and a utility fluid in a hydroprocessing reactor, wherein the utility fluid typically comprises ≥90.0 wt. % of aromatics and ≤10.0 wt. % of paraffin. The second step is periodically decreasing the weight ratio of the pyrolysis tar to the utility fluid in the feed.

More particularly, the invention relates to a pyrolysis tar upgrading process which includes providing a reactor zone containing catalyst, a treat gas, and a feed mixture, wherein (i) the feed mixture comprises a first utility fluid and ≥10.0 wt. % of pyrolysis tar, (ii) the feed mixture has a first utility fluid:pyrolysis tar weight ratio in the range of from about 0.05 to about 4.0, (iii) the first utility fluid comprises aromatics. The pyrolysis tar can be any of the specified pyrolysis tars, e.g., one comprising ≥2 wt. % sulfur, and ≥0.1 wt. % of TH.

In accordance with these aspects, the feed mixture is conducted into the reactor zone at an LHSV ≥0.1 $m^3$ of (pyrolysis tar+utility fluid) per $m^3$ of the catalyst. At least a portion of the feed mixture is converted in the reactor zone to a conversion product, which is conducted away from the reactor. The conversion can be carried out under the specified conversion conditions, e.g., at an average reactor zone temperature ≥50° C., e.g., ≥100° C., such as ≥300° C., or in the range of about 350° C. to 430° C.; a reaction zone pressure ≥10 bar(g); and a treat gas rate ≥75 standard $m^3$ of molecular hydrogen per $m^3$ of feed mixture. The reactor zone generally has an initial pressure-drop $\Delta P_1$, e.g., $\Delta P_1 \leq 1.7$ bar(g) at the start of the converting.

A hydroprocessed product can be separated from the conversion product, with at least a first portion of the separated hydroprocessed product being recycled for use as the utility fluid. The recycled portion of the hydroprocessed product can have a boiling range of, e.g., from 175° C. to 400° C.

Hydroprocessing of the pyrolysis tar generally continues until the reactor zone's pressure drop increases to a second pressure-drop $\Delta P_2$, e.g., $\Delta P_2 \geq 3.4$ bar(g), after which a second utility fluid (e.g., primer fluid) is introduced into the reactor. The specified hydroprocessing conditions can be used. Neither cooling the reactor to ambient temperature nor depressurizing the reactor is necessary. The reactor can be maintained at pyrolysis tar hydroprocessing temperature and pressure, e.g., maintained an average reactor zone temperature ≥100° C., e.g., in the range of about 100° C. to 430° C., such as 350° C. to 430° C., while the second utility fluid is flowing through the reactor. In certain aspects, the average reactor zone temperature is in the range of about 100° C. to 300° C. and the reactor pressure is in the range of about 34 bar(g) to about 68 bar(g), while the second utility fluid is flowing through the reactor. Conducting the second utility fluid through the reactor under the specified conditions results in a lessening of reactor pressure drop to a value $\Delta P_3$, e.g., $\Delta P_3 \leq 1.7$ bar(g). The flow of second utility fluid is generally curtailed after the pressure drop has decreased to a predetermined desired value, such as ≤1.7 bar(g). The process can be operated continuously, with the second utility fluid being flowed through the reactor periodically, e.g., each time the rector pressure drop exceeds a predetermined unacceptable level, such as 3.4 bar(g). The second utility fluid can comprise any of the utility fluids specified for pyrolysis tar hydroprocessing, e.g., primer fluid and/or a second portion of the hydroprocessed product. In certain aspects, the second utility fluid comprises ≥90.0 wt. % of aromatics.

Although it is not required, a more rapid decrease in reactor pressure drop is obtained when the flow of treat gas and/or feed mixture is lessened (or even substantially discontinued) before conducting the second utility fluid through the reactor. For example, an inert gas such as nitrogen can substitute for at least a portion of the treat gas while the second utility fluid substitutes for at least a portion of the feed mixture. The inert gas can be any of the specified inert gases. In certain aspects, the conducting of feed mixture is lessened and/or the second utility fluid is introduced in amounts sufficient to achieve a [first utility fluid+second utility fluid]:pyrolysis tar weight ratio >4.0. After achieving the desired decrease in reactor pressure drop, the flow of treat gas and feed mixture can be restored, e.g., to approximately their original values utilized for pyrolysis tar hydroprocessing. For example, the flow of treat gas and feed mixture can be restored to achieve a [first utility fluid+second utility fluid]:feed mixture weight ratio in the reactor zone in the range of from 0.05 to 4.0, where the amount of second utility fluid can be zero. Optionally, the [feed mixture+second utility fluid] amount (weight basis) conducted through the reactor is substantially constant before, during, and after the second utility fluid is conducted through the reactor. In other words, the flow of feed mixture can be decreased as the flow of second utility fluid is increased, and vice versa.

Although reactor pressure drop can be lessened by use of a second utility fluid, this is not required. In other aspects, pressure drop is lessened by increasing the amount of first utility conducted through the reactor, e.g., by increasing the relative amount of first utility fluid in the pyrolysis tar-utility fluid mixture. Accordingly, certain aspects of the invention relate to a pyrolysis tar upgrading process which includes providing pyrolysis tar, a reactor zone, catalyst within the reactor zone, treat gas, and utility fluid, the utility fluid comprising aromatics. As in the preceding aspects, the pyrolysis tar, treat gas, and utility fluid can be any can be any of those specified in this description. In certain aspects, the pyrolysis tar can comprise a steam cracker tar having (i) a sulfur content in the range of 0.5 wt. % to 7.0 wt. %; (ii) a TH content in the range of from 5.0 wt. % to 40.0 wt. %; (iii) a density at 15° C. in the range of 1.01 g/$cm^3$ to 1.15 g/$cm^3$; and (iv) a 50° C. viscosity in the range of 200 cSt to $1.0\times10^7$ cSt. The treat gas, utility fluid, and pyrolysis tar are conducted into the reactor zone, where at least a portion of the pyrolysis tar is converted to produce a conversion product. Process conditions can be the same as those specified in preceding aspects. For example, the process conditions can include a treat gas flow rate of ≥75 standard $m^3$ of molecular hydrogen per $m^3$ of [the pyrolysis tar+the utility fluid], a utility fluid LHSV ≥0.01 $m^3$ of the utility fluid per $m^3$ of the catalyst, a pyrolysis tar LHSV ≥0.09 $m^3$ of the pyrolysis tar per $m^3$ of the catalyst, an average reactor zone temperature in the range of 350° C. to 430° C., and an average reactor pressure ≥10 bar(g). As in the preceding aspects, a conversion product can be conducted away from the hydroprocessing reactor. Pyrolysis tar hydroprocessing generally continues until the reactor zone's pressure drop increases to a value ≥3.4 bar(g). The pressure drop is then lessened by decreasing the pyrolysis tar's LHSV and/or increasing the first utility fluid's LHSV. For example, the pyrolysis tar's LHSV can be reduced to a value ≤0.09 $m^3/m^3$ and/or the utility fluid's LHSV can be increased to a value ≥0.1 $m^3/m^3$, e.g., in the range of from 0.1 to 3.0. These LHSV adjustments can be carried out while maintaining the reactor temperature in a range suitable for pyrolysis tar hydroprocessing, e.g., an average reactor zone temperature in the range of about 100° C. to 430° C., such as 350° C. to 430° C. Lessening the pyrolysis tar's LHSV and/or increasing the utility fluid's LHSV reduces the reactor pressure drop, e.g., to ≤1.7 bar(g).

As in the preceding aspects, the flow of treat gas can lessened or substantially discontinued before or during (i) the increase of utility fluid LHSV or (ii) decrease of pyrolysis tar LHSV. The process can be operated continuously, e.g., periodically increasing utility fluid LHSV and periodically decreasing pyrolysis tar LHSV under the specified conditions in order to lessen reactor pressure drop whenever an unacceptable pressure drop occurs.

Optionally, a second utility fluid can be used together with the first utility fluid. For example, a second utility fluid can be introduced into the reactor during or after the decreasing of the pyrolysis tar's LHSV, the second fluid comprising ≥90.0 wt. % of aromatics, based on the weight of the second utility fluid. Using a second utility fluid is beneficial, e.g., when the process generates insufficient first utility fluid to achieve the desired utility fluid LHSV for reducing reactor pressure drop. Optionally, the first and second utility fluid have a combined LHSV in the range of from 0.1 $m^3$ of [the first utility fluid+the second utility fluid] per $m^3$ of the catalyst to 3.0 $m^3$ of [the first utility fluid+the second utility fluid] per $m^3$ of catalyst.

Certain aspects of the invention are further described in the following examples.

Example 1

A tube reactor having a diameter of approximately 9.4 mm is loaded with approximately 17.5 $cm^3$ of a conventional supported hydroprocessing catalyst having nickel and molybdenum catalytic metals. Catalyst activation is performed using an activating fluid, the activating fluid comprising 80 wt. % 130N lubricating oil basestock and 20 wt. % ethyldisulfide, using the procedure specified in Example 1 of U.S. Patent Application Publication No. 2014-0061904A1.

After approximately 40 hours of activation, the reactor is purged with nitrogen for approximately one hour. Following the nitrogen purge, a pyrolysis tar-utility fluid mixture and treat gas are introduced into the reactor, with the reactor operating under pyrolysis tar hydroprocessing conditions selected to provide 70 wt. % conversion of the pyrolysis tar's 566° C.$^+$ fraction. The pyrolysis tar is filtered upstream of the reactor to remove constituents having a size ≥50 micrometers.

As shown in FIG. 1, reactor pressure rapidly (approximately exponentially) increased after the start of pyrolysis tar hydroprocessing. After achieving a reactor pressure drop 17 bar(g), the reactor was shut down.

Example 2

Figure 2:
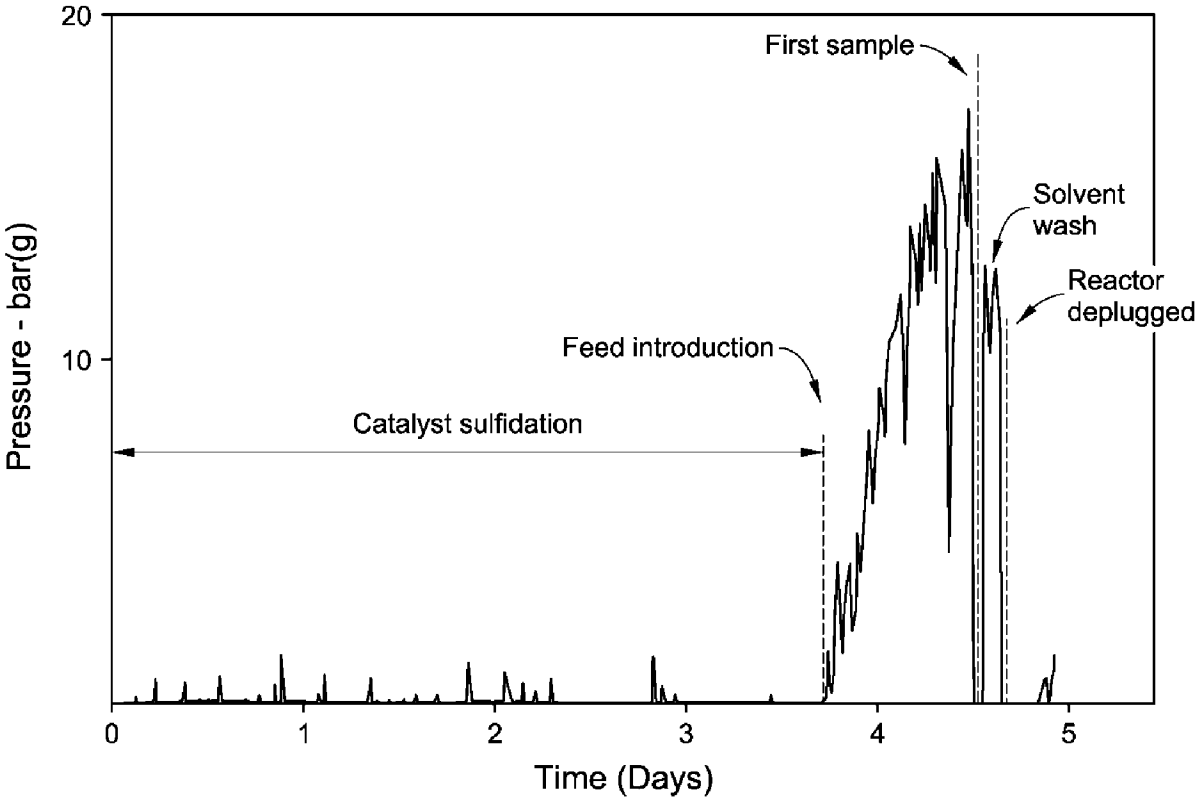
FIG. 2 is a graph showing the variation of hydroprocessing reactor pressure over time during catalyst activation, after the start of pyrolysis tar hydroprocessing, while conducting primer fluid through the reactor, and after re-starting pyrolysis tar hydroprocessing.

Example 1 is repeated, except that after reactor shutdown a nitrogen purge is performed for approximately one hour. Following the nitrogen purge, a second utility fluid comprising 100% (wt. basis) primer fluid is conducted through the reactor at an LHSV of approximately 0.7 $m^3/m^3$ for approximately two hours with the reactor stabilized at a temperature of approximately 250° C. and a pressure of approximately 60 bar(g). After purging the reactor with nitrogen for about one hour, tar hydroprocessing was restarted under substantially the same conditions as before reactor shutdown. As Shown in FIG. 2, conducting primer fluid through the reactor under the specified conditions lessened reactor pressure drop to a value ≤1.7 bar(g).

All patents, test procedures, and other documents cited herein, including priority documents, are fully incorporated by reference to the extent such disclosure is not inconsistent and for all jurisdictions in which such incorporation is permitted.

While the illustrative forms disclosed herein have been described with particularity, it will be understood that various other modifications will be apparent to and can be readily made by those skilled in the art without departing from the spirit and scope of the disclosure. Accordingly, it is not intended that the scope of the claims appended hereto be limited to the example and descriptions set forth herein, but rather that the claims be construed as encompassing all the features of patentable novelty which reside herein, including all features which would be treated as equivalents thereof by those skilled in the art to which this disclosure pertains.

When numerical lower limits and numerical upper limits are listed herein, ranges from any lower limit to any upper limit are contemplated.

The invention claimed is:

1. A pyrolysis tar upgrading process, the process comprising:

(a) providing at least
  (i) a reactor zone, the reactor zone containing catalyst;
  (ii) a utility fluid, the utility fluid comprising ≥90.0 wt. % of aromatics and ≤10.0 wt. % of paraffin;
  (iii) a pyrolysis tar;
  (iv) an activating fluid, wherein
    (A) the activating fluid comprises carrier fluid and ≥5.0 wt. % of at least one activator,
    (B) the carrier fluid comprises ≥90.0 wt. % of paraffin and ≤10.0 wt. % of aromatics, and
  (v) a treat gas, wherein the treat gas comprises ≥50.0 vol. % of molecular hydrogen;

(b) contacting the treat gas and the activating fluid with the catalyst in the reactor zone under catalyst activation conditions, the catalyst activation conditions including an LHSV ≥0.01 $m^3$ of activating fluid per $m^3$ of the catalyst;

(c) decreasing the activating fluid LHSV to <0.01 $m^3$ of activating fluid per $m^3$ of the catalyst and then contacting the utility fluid with the catalyst in the reactor at a utility fluid LHSV ≥0.1 $m^3$ of utility fluid per $m^3$ of the catalyst;

(d) transferring the pyrolysis tar to the reactor and contacting the pyrolysis tar, treat gas, and utility fluid with the catalyst under conversion conditions to produce a conversion product, the conversion conditions including (i) an LHSV ≥0.1 $m^3$ of (pyrolysis tar+utility fluid) per $m^3$ of the catalyst, (ii) a temperature ≥100° C. and a pressure ≥34 bar(g), and (iii) a utility fluid:pyrolysis tar weight ratio in the range of from about 0.05 to about 4.0, (e) separating a hydroprocessed product from the conversion product; and (f) substituting at least a portion of the separated hydroprocessed product for at least a portion of the utility fluid during step (d) to achieve a [(substituted hydroprocessed product+utility fluid):pyrolysis tar] weight ratio in the range of from about 0.05 to about 4.0.

2. The process of claim 1, wherein the catalyst activation conditions of step (b) include exposing the catalyst, treat gas, and activating fluid to a temperature ≥200° C. and a pressure ≥700 kPa, and wherein the activator includes one or more of methylsulfide, ethylsulfide, methyldisulfide, ethyldisulfide, dimethylsulfide, diethylsulfide, dimethyldisulfide, dimethylsulfoxide, tert-butyl polysulfide, and di-tert-butyl polysulfide.

3. The process of claim 1, wherein the conversion conditions of step (d) include one or more of a temperature in the range of 360° C. to 425° C., a pressure in the range of 47 bar(g) to 133 bar(g), and a molecular hydrogen consumption rate of 148 S $m^3/m^3$ to 1180 S $m^3/m^3$.

4. The process of claim 1, wherein the pyrolysis tar comprises ≥0.1 wt. % of tar heavies and ≤5.0 wt. % of (i) vinyl aromatics and/or (ii) aggregates incorporating vinyl aromatics.

5. The process of claim 1, wherein the utility fluid has a final boiling point ≤430° C. (806° F.), and comprises ≥25.0 wt. % of 1-ring and 2-ring aromatics.

6. The process of claim 1, wherein step (f) includes substituting at least a portion of the hydroprocessed product for substantially all of the utility fluid of step (d), to achieve a [substituted hydroprocessed product:pyrolysis tar] weight ratio in the range of from about 0.3 to 1.1.

7. The process of claim 1, wherein the hydroprocessing catalyst comprises (i) ≥1 wt. % of one or more metals selected from Groups 6, 8, 9, and 10 of the Periodic Table and (ii) ≥1 wt. % of an inorganic oxide, the weight percents being based on the weight of the hydroprocessing catalyst.

8. The process of claim 1, wherein (a) the reactor zone has (i) a first pressure-drop $\Delta P_1$ at the start of step (b) and (ii) a second pressure-drop $\Delta P_2$ during step (d), wherein $\Delta P_1$ is ≤3.4 bar(g) and $\Delta P_2$≤14 bar(g) for at least $8.6\times10^4$ seconds after the start of step (d).

9. The process of claim 8 wherein $\Delta P_2$ is ≤10 bar(g) for at least $8.6\times10^4$ seconds after the start of step (d).

10. The process of claim 1, wherein the pyrolysis tar is steam cracker tar.

11. A pyrolysis tar upgrading process, the process comprising:

(a) providing (i) a reactor zone containing catalyst and (ii) a treat gas, wherein the treat gas comprises ≥50.0 vol. % of molecular hydrogen;

(b) providing a feed mixture, wherein (i) the feed mixture comprises a first utility fluid and ≥10.0 wt. % of pyrolysis tar, (ii) the feed mixture has a first utility fluid:pyrolysis tar weight ratio in the range of from about 0.05 to about 4.0, (iii) the first utility fluid comprises aromatics;

(c) conducting the treat gas and feed mixture into the reactor zone at an LHSV ≥0.1 $m^3$ of (pyrolysis tar+utility fluid) per $m^3$ of the catalyst, converting least a portion of the feed mixture in the reactor zone to a conversion product, and separating a hydroprocessed product from the conversion product, wherein (i) the converting is carried out at an average reactor zone temperature in the range of about 350° C. to 430° C., a pressure ≥10 bar(g), and a treat gas rate ≥75 standard $m^3$ of molecular hydrogen per $m^3$ of feed mixture, and (ii) the reactor zone has a first pressure-drop $\Delta P_1$;

(d) recycling at least a first portion of the separated hydroprocessed product, the first portion having an atmospheric boiling range of from 175° C. to 400° C., and substituting the first portion of the separated hydroprocessed product for at least a portion of the first utility fluid in the feed mixture;

(e) (i) continuing steps (c) and (d) until the reactor zone's pressure drop increases to a second pressure-drop $\Delta P_2$, and then (ii) introducing into the reactor zone a second utility fluid while maintaining the average reactor zone temperature in the range of about 350° C. to 430° C. to achieve a third pressure-drop $\Delta P_3$ which is $<\Delta P_2$, wherein the second utility fluid comprises ≥90.0 wt. % of aromatics; and (f) lessening the introducing of the second utility fluid.

12. The process of claim 11, further comprising:

(g) repeating steps (c)-(f).

13. The process of claim 11, wherein step (e)(ii) includes lessening the conducting of feed mixture and treat gas into the reactor zone.

14. The process of claim 13, wherein during step (e) (ii) the conducting of feed mixture is lessened and/or the second utility fluid is introduced in amounts sufficient to achieve a [first utility fluid+second utility fluid]:pyrolysis tar weight ratio >4.0.

15. The process of claim 13, wherein step (f) includes increasing the conducting of feed mixture into the reactor zone.

16. The process of any of claim 15, wherein during step (f) the conducting of feed mixture is increased and/or the introducing of the second utility fluid is lessened to achieve a [first utility fluid+second utility fluid]:feed mixture weight ratio in the reactor zone in the range of from 0.05-4.0.

17. The process of claim 11, wherein (A) inert gas is substituted for at least a portion of the treat gas during step (e) (ii), (B) $\Delta P_1$≤1.7 bar(g), (C) $\Delta P_2$≥3.4 bar(g), and (D) $\Delta P_3$≤1.7 bar(g).

18. The process of claim 11, wherein the [feed mixture+second utility fluid] amount (weight basis) conducted through the reactor is substantially constant during steps (c)-(f).

19. The process of claim 11, wherein (i) the pyrolysis tar comprises ≥2 wt. % sulfur, and ≥0.1 wt. % of Tar Heavies, the weight percents being based on the weight of the pyrolysis tar, and (ii) the second utility fluid comprises primer fluid.

20. The process of claim 11 wherein the second utility fluid comprises a second portion of the hydroprocessed product.

21. A pyrolysis tar upgrading process, the process comprising:

(a) providing a reactor zone, catalyst within the reactor zone, and a treat gas, wherein the treat gas comprises ≥50.0 vol. % of molecular hydrogen;

(b) providing a utility fluid, the utility fluid comprising aromatics;

(c) providing a pyrolysis tar;

(d) conducting the treat gas, utility fluid, and pyrolysis tar into the reactor zone and converting in the reactor zone at least a portion of the pyrolysis tar to produce a conversion product, the reactor zone having a first pressure-drop $\Delta P_1$ at the start of the converting, wherein (i) the treat gas is conducted at a flow rate of ≥75 standard $m^3$ of molecular hydrogen per $m^3$ of [the pyrolysis tar+the utility fluid];

(ii) the utility fluid is conducted at an LHSV ≥0.01 $m^3$ of the utility fluid per $m^3$ of the catalyst, (iii) the pyrolysis tar is conducted at an LHSV ≥0.09 $m^3$ of the pyrolysis tar per $m^3$ of the catalyst, and (iv) the converting is carried out at an average reactor zone temperature in the range of 350° C. to 430° C. and an average reactor pressure ≥10 bar(g);

(e) separating a hydroprocessed product from the conversion product, the separated hydroprocessed product having an atmospheric boiling range of from 175° C. to 400° C., and substituting at least a portion of the separated hydroprocessed product for at least a portion of the first utility fluid in step (d);

(f) continuing steps (d) and (e) until the reactor zone's pressure drop increases to a second pressure-drop $\Delta P_2$, and then (i) decreasing the pyrolysis tar's LHSV to <0.09 $m^3/m^3$ and/or (ii) increasing the utility fluid's LHSV to ≥0.10 m3/$m^3$, while maintaining the average reactor zone temperature in the range of about 350° C. to 430° C. in order to decrease the reactor zone's pressure drop to a third pressure-drop $\Delta P_3$, and then (g) repeating steps (d) and (e).

22. The process of claim 21, wherein (A) after decreasing the pyrolysis tar's LHSV in step (f) the first utility fluid's LHSV is in the range of from 0.1 to 3.0, (B) $\Delta P_1 \leq 1.7$ bar(g), (C) $\Delta P_2 \geq 3.4$ bar(g), and (D) $\Delta P_3 \leq 1.7$ bar(g).

23. The process of claim 21, wherein step (f) further comprises conducting into the reactor zone a second utility fluid during or after the decreasing of the pyrolysis tar's LHSV, the second fluid comprising ≥90.0 wt. % of aromatics, based on the weight of the second utility fluid.

24. The process of claim 23, wherein after decreasing the pyrolysis tar's LHSV in step (f) the first and second utility fluid have a combined LHSV in the range of from 0.1 $m^3$ of [the first utility fluid+the second utility fluid] per $m^3$ of the catalyst to 3.0 $m^3$ of [the first utility fluid+the second utility fluid] per $m^3$ of catalyst.

25. The process of claim 21, wherein the pyrolysis tar comprises steam cracker tar, having (i) a sulfur content in the range of 0.5 wt. % to 7.0 wt. %; (ii) a TH content in the range of from 5.0 wt. % to 40.0 wt. %; (iii) a density at 15° C. in the range of 1.01 g/$cm^3$ to 1.15 g/$cm^3$; and (iv) a 50° C. viscosity in the range of 200 cSt to $1.0 \times 10^7$ cSt.

* * * * *